United States Patent [19]

Crawford et al.

[11] Patent Number: 4,506,576

[45] Date of Patent: Mar. 26, 1985

[54] MAT BOARD CUTTER WITH KNIFE BLADE SECURING SAFETY PIN

[75] Inventors: Dennis L. Crawford, Roberts, Wis.; Donald J. Mitchell, St. Paul, Minn.

[73] Assignee: Minnesota Mining and Manufacturing Company, St. Paul, Minn.

[21] Appl. No.: 512,115

[22] Filed: Jul. 7, 1983

[51] Int. Cl.[3] ..... B26D 7/02

[52] U.S. Cl. ..... 83/455; 83/564; 83/614; 83/698

[58] Field of Search ..... 83/454–455, 83/614, 563–564, 698–700; 279/79, 86, 97; 30/329–339

[56] References Cited

U.S. PATENT DOCUMENTS

| | | | |
|---|---|---|---|
| 2,671,962 | 3/1954 | Spurzem | 30/337 X |
| 3,236,136 | 2/1966 | Bach | 83/614 |
| 3,308,533 | 3/1967 | Holohan | 30/338 |
| 3,527,131 | 9/1970 | Ellerin | 83/614 X |
| 4,022,095 | 5/1977 | Jones | 83/614 X |
| 4,036,486 | 7/1983 | Molpus | 269/303 |
| 4,158,977 | 6/1979 | Logan | 83/614 X |

*Primary Examiner*—James M. Meister
*Assistant Examiner*—John L. Knoble
*Attorney, Agent, or Firm*—Donald M. Sell; James A. Smith; William L. Huebsch

[57] ABSTRACT

A mat board cutter in which a knife blade carrying pivot block mounted on a slidable body also carries a safety pin that must be pushed against a spring to a release position to allow removal of the knife blade from the pivot block.

4 Claims, 4 Drawing Figures

MAT BOARD CUTTER WITH KNIFE BLADE SECURING SAFETY PIN

TECHNICAL FIELD

The present invention relates to mat board cutters, and particularly to means in a mat board cutter for retaining a knife blade in a pivot block pivotably mounted on a slidable cutter carrying body.

BACKGROUND ART

U.S. Pat. No. 4,036,486, incorporated herein by reference, describes a mat board cutter by which a mat board is cut to have a desired peripheral size to fit within a desired frame and to have a desired central opening through which a picture being framed is visible.

As described in greater detail in U.S. Pat. No. 4,036,486, cutting the mat board requires sliding a cutter-carrying body along a guide rail with a knife blade included in a cutter device or assembly pivotably carried on the body in engagement with the mat, which mat is held in a predetermined position by abutment means on a base and a clamp bar on which the guide rail is mounted.

The knife blade included in the cutter assembly is thin and has a truncated pyramidal periphery with a cutting edge along its base, opposite end edges converging from its cutting edge, and a top edge parallel to its cutting edge. Also included in the cutter assembly is a pivot block having a socket receiving the knife blade with an end portion of the knife blade and its cutting edge projecting out of the socket, and means in the form of a thumb screw adapted to bear against one side surface of the knife blade for releasably fixing the knife blade in the socket. Means are provided for mounting the pivot block on the cutter-carrying body for povital movement between a disengaged position with the projecting portion of the knife blade spaced from a mat board on the cutter, and an engaged position with the knife blade engaged with the mat board. With this design, the possibility exists that if the thumb screw is not securely tightened or works loose during use of the mat board cutter, the knife blade can slide from within the socket and move to a position at which it can injure a user.

DISCLOSURE OF INVENTION

The present invention provides a cutter assembly for a mat board cutter of the type described above which includes means for retaining the knife blade in the socket in the pivot block even though the thumb screw should be or become loosened, and to thereby restrict injury to a user of the mat board cutter.

According to the present invention there is provided an improved mat board cutter of the type having a base with abutment means for positioning a mat board thereon, a clamp bar for clamping the mat board on the base, a guide rail on the clamp bar and a cutter-carrying body slideably mounted on the guide rail. Also included is at least one cutter assembly including a thin knife blade having a truncated pyramidal periphery with a cutting edge along its base and opposite end edges converging from its cutting edge, and a pivot block having a socket receiving the knife blade with an end portion of the blade including a portion of its cutting edge projecting out from the pivot block, and means for releasably fixing the knife blade in the socket. Means are provided for pivotably mounting the pivot block on the cutter-carrying body for movement between a disengaged position with the knife spaced from the mat board and an engaged position with the knife engaged with the mat board.

The improved cutter includes a safety pin having a transverse groove opening through one side. The pin is mounted on the pivot block for movement along a path through and transverse of the socket receiving the knife blade between a blocking position with the groove spaced from the socket and a portion of the pin positioned to engage the outermost end edge of the blade in the socket to retain the blade in the socket upon release of the means for releasably fixing the blade in the socket, and a release position with the groove aligned with the socket to permit movement of the knife blade through the groove and out of the socket upon release of the means for releasably fixing the knife blade in the socket; and means for biasing the pin to its blocking position.

As illustrated, the safety pin has a head at one end, the end portion of the pin opposite the head is slidably mounted in the pivot block, and the means for biasing the pin to its blocking position is a coil spring around the pin between its head and the pivot block.

BRIEF DESCRIPTION OF DRAWING

The present invention will be further described with reference to the accompanying drawing wherein like numbers refer to like parts in the several views, and wherein.

DETAILED DESCRIPTION

Figure 1:
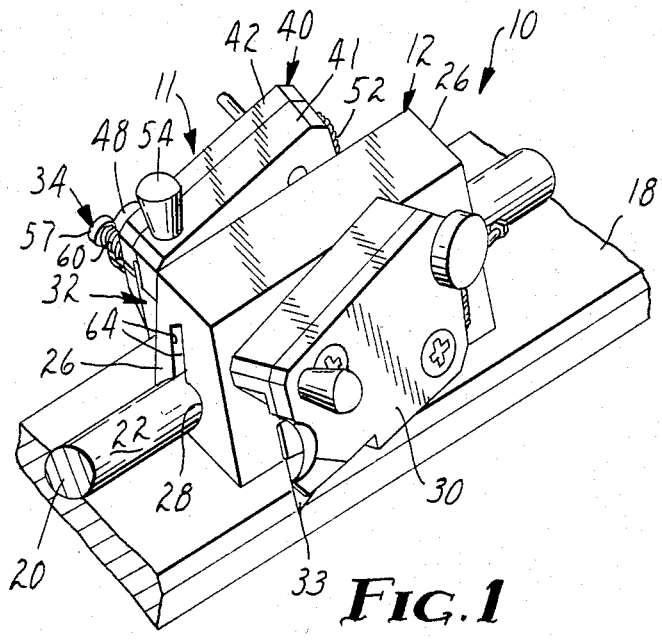
FIG. 1 is a fragmentary perspective view of a mat board cutter including a cutter assembly according to the present invention.

Referring now to the drawing there is shown a portion of a mat board cutter 10 including an improved cutter assembly 11 according to the present invention pivotably mounted on a cutter-carrying body 12.

The mat board cutter 10 is generally the same as the mat board cutter described in U.S. Pat. No. 4,036,486, incorporated herein by reference, in that it comprises a base (not shown) with abutment means for positioning a mat board thereon; a clamp bar 18 for clamping the mat board on the base; a guide rail 20 fixed on the clamp bar 18 having a cylindrical peripheral guide surface 22; the cutter-carrying body 12 which has spaced ends 26 and a bearing surface 28 defining a through opening between its ends 26, which bearing surface 28 receives the guide rail 20 in close-fitting relationship so that the bearing surface 28 of the body 12 can slide along and will be guided by the peripheral guide surface 22 of the guide rail 20; and two cutter assemblies including the cutter device 11 which is mounted along a vertical side surface of the body 12 and is thus adapted to make vertical cuts in the mat board, and an additional cutter assembly 30 which is mounted along an inclined side surface of the body 12 and is thus adapted to make slanted cuts in the mat board. Each of the cutter assemblies 11 and 30 includes a knife blade 32 and 33 respectively and is pivotably mounted on a different side surface of the cutter-carrying body 12 for pivotal movement between a disengaged position with the knife blade 32 or 33 spaced from the mat board, and an engaged position with the knife blade 32 or 33 engaged with the mat board.

Figure 2:
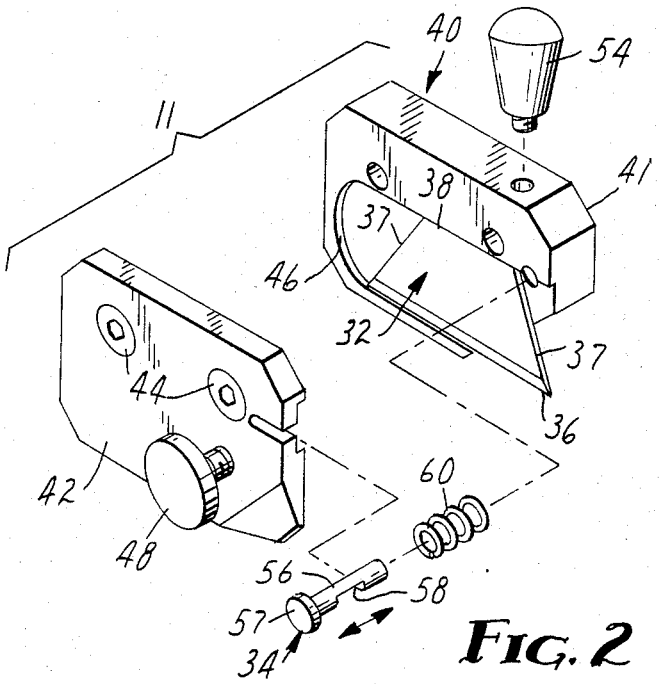
FIG. 2 is an exploded perspective view of the cutter assembly according to the present invention shown in FIG. 1.
Figure 3:
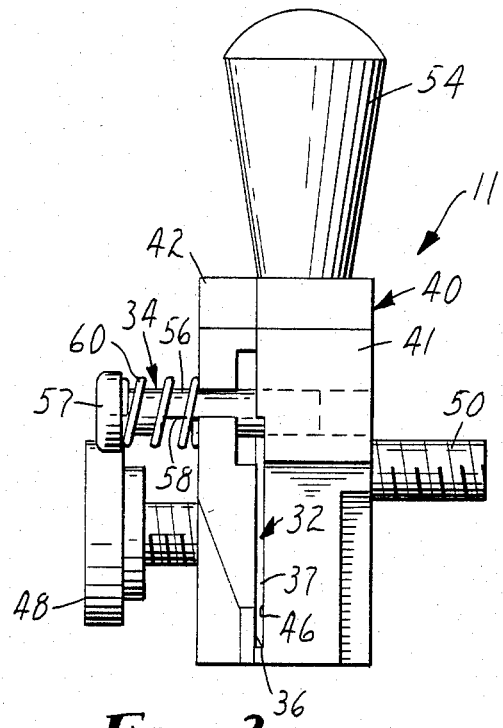
FIGS. 3 and 4 are end views of the cutter assembly of FIG. 1 shown with a safety pin respectively in a blocking and a release position.
Figure 4:
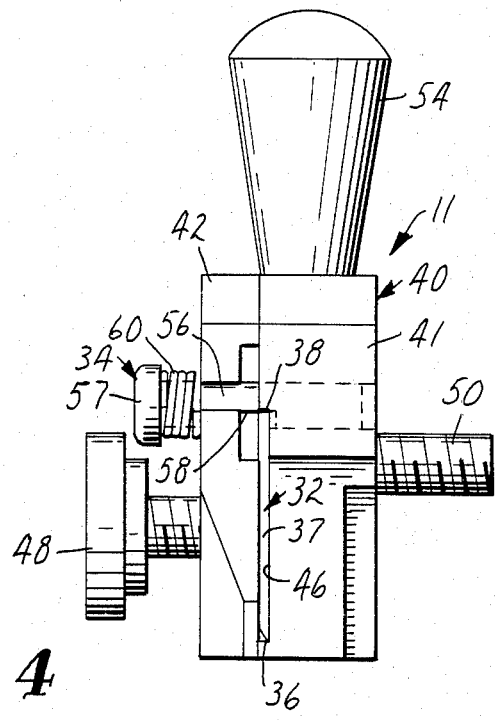

The improved cutter assembly 11 is best seen in FIG. 2. The cutter assembly 11 includes means in the form of a safety pin 34 for retaining the knife blade 32 in the rest of the cutter assembly 11 until the safety pin 34 is manually manipulated.

The knife blade 32 included in the cutter assembly 11 is thin, and has a truncated pyramidal periphery with a cutting edge 36 along its base, opposite end edges 37 converging from its cutting edge 36 and a top edge 38 parallel to its cutting edge 36. In addition to the knife 32, the cutter assembly 11 also includes a pivot block 40 including inner and outer seperable portions 41 and 42 held together by two screws 44 and defining a socket 46 therebetween which opens through an end of the pivot block 40 and receives the knife blade 32 with an end portion of the knife blade 32 and its cutting edge 36 projecting outwardly from the pivot block 40. Means in the form of a thumb-screw 48 threadably engaged through the outer portion 42 of the pivot block 40 along the socket 46 are provided for fixing the knife blade 32 in the socket 46 by pressing it against the inner portion 41 of the pivot block 40 when the thumb-screw 48 is manually tightened. The pivot block 40 is mounted on the body 12 by a pivot bolt 50 that extends through its inner portion 40 into the body 12 for pivotal movement around the pivot bolt 50 between a disengaged position (to which the pivot block 40 is biased by a coil spring 52 between the pivot block 40 and body 12) with the knife blade 32 spaced from the mat board, and an engage position to which the pivot block 40 may be manually pressed against the bias of the spring 52 by use of a handle 54 at which the knife blade 32 is engaged with the mat board.

The safety pin 34 for retaining the knife blade 32 in the socket 46 includes a main portion 56 and a head 57 on one end of the main portion 56, and has a transverse groove 58 in the main portion 56 opening through one side of the pin 34 so that the main portion 56 is cylindrical except along the groove 58 where it is semi-circular. The inner portion 41 of the pivot block 40 has a opening which slidably receives the cylindrical main portion 56 of the safety pin 34 and the outer portion 42 of the pivot block 40 has a slot opening through its edge and aligned with the cylincrical opening in the inner portion 41, which slot will receive only the semi-circular portion of the safety pin 34 adjacent the groove 58, thereby mounting the safety pin 34 for movement along a path through and transverse of the socket 46 between an outer or locking position to which the pin 34 is biased by a coil spring 60 around the pin 34 between its head 57 and the outer portion 42 of the pivot block 40 which is defined by engagement of the circular portion of the safety pin 34 at the end of the socket 46 opposite its head 51 with the outer portion 42 of the block 40; and an inner or release position to which the safety pin 34 can be manually pressed against the bias of the spring 60 which is defined by engagement of the circular portion of safety pin 34 at the end of the socket 46 adjacent the head 57 with the outer portion 42 of the block 40. At the locking or outer position of the safety pin 34, its cylindrical main portion 56 will extend across the socket 46 adjacent the outer end edge 37 of the blade 32 and will preclude movement of that outer end edge 37 and thereby the knife blade 32 out of the socket 46.

In its inner or release position, however, the groove 58 will be aligned with the socket 46 allowing the outer end edge 37 and the top edge 38 of the knife blade 32 to move through the groove 58 and the knife blade 32 to move out of the socket 46.

Thus to remove the knife blade 32, a user must both release the thumb-screw 48 and press the safety pin 34 inwardly to its release position against the bias of the spring 60, and the safety pin 54 will preclude movement of the blade 32 out of the socket 46 even during use of the mat cutter should the thumb screw 48 become inadvertently loosened.

As is more thoroughly explained in U.S. patent application Ser. No. 486,896 filed Apr. 20, 1983 (incorporated herein by reference), the cutter carrying body 12 is preferably of an improved type having spaced opposed surfaces 64 defining a slot extending between its ends 26 and communicating along one edge with the through opening defined by the bearing surface 28 in which the guide rail 20 is received, and means provided by screws (not shown) extending through the slot for adjusting the spacing between the opposed surfaces 64 defining the slot to position the bearing and guide surfaces 28 and 22 in close-fitting relatively slidable relationship.

It will be appreciated that modifications can be made to the improved cutter 11 without departing from the spirit of the present invention. Thus the scope of the present invention should not be limited to the structure of the body as illustrated, but should include all structures described by the language of the claims and their equivalents.

We claim:

1. In a mat board cutter having a base with means for positioning a mat board thereon; a clamp bar for clamping the mat board on said base; a guide rail on said clamp bar; a cutter-carrying body slideably mounted on the guide rail; at least one cutter assembly including a thin knife blade having a truncated pyramidal periphery with a cutting edge along its base and opposite end edges converging from said cutting edge, a pivot block having a socket receiving said knife blade with an end portion of said knife blade and a portion of said cutting edge projecting out of said socket, and means for releasably fixing said knife blade in said socket; and means for mounting said pivot block on said cutter-carrying body for pivotal movement between a disengaged position with the knife blade spaced from the mat board and an engaged position with the knife engaged with the mat board, the improvement wherein:

said cutter assembly includes a safety pin having a transverse groove opening through one side and being mounted on said pivot block for movement along a path through and transverse of said socket between a blocking position with said groove spaced from said socket and a portion of said pin positioned to engage the outer end edge of said knife blade to block movement of said blade out of said socket upon release of said means for releasably fixing, and a release position with said groove aligned with said socket to permit movement of said blade out of said socket upon release of said means for releasably fixing, and means for biasing said safety pin to said blocking position.

2. A mat board cutter according to claim 1 wherein said safety pin has a head at one end, the end of said safety pin opposite said head is slidably mounted in said pivot block, and said means for biasing said safety pin to said blocking position is a coil spring around said safety pin between said head and said pivot block.

3. In a cutter assembly including a thin knife blade having a truncated pyramidal periphery with a cutting edge along its base and opposite end edges converging from said cutting edge, a pivot block having a socket receiving said knife blade with an end portion of said knife blade and a portion of said cutting edge projecting out of said socket, and means for releasably fixing said knife blade in said socket, said cutter assembly being adapted to be mounted on a slideably mounted cutter-carrying body for pivotal movement between a disengaged position with the knife blade spaced from a mat board and an engaged position with the knife engaged with the mat board, the improvement wherein:

said cutter assembly includes a safety pin having a transverse groove opening through one side and being mounted on said pivot block for movement along a path through and transverse of said socket between a blocking position with said groove spaced from said socket and a portion of said pin positioned to engage the outer end edge of said knife blade to block movement of said blade out of said socket upon release of said means for releasably fixing, and a release position with said groove aligned with said socket to permit movement of said blade out of said socket upon release of said means for releasably fixing, and means for biasing said safety pin to said blocking position.

4. A cutter assembly according to claim 3 wherein said safety pin has a head at one end, the end of said safety pin opposite said head is slidably mounted in said pivot block, and said means for biasing said safety pin to said blocking position is a coil spring around said safety pin between said head and said pivot block.

* * * * *